United States Patent [19]

Reist

[11] 4,445,681

[45] May 1, 1984

[54] APPARATUS FOR REMOVING FLEXIBLE FLAT PRODUCTS FROM A PRODUCT STREAM

[75] Inventor: Walter Reist, Hinwil, Switzerland

[73] Assignee: Ferag AG, Hinwil, Switzerland

[21] Appl. No.: 297,216

[22] Filed: Aug. 28, 1981

[30] Foreign Application Priority Data

Sep. 16, 1980 [CH] Switzerland ..... 6923/80
Apr. 9, 1981 [CH] Switzerland ..... 2388/81

[51] Int. Cl.[3] ..... B65H 29/04

[52] U.S. Cl. ..... 271/300; 271/188; 271/199; 271/204; 271/209; 271/307

[58] Field of Search ..... 271/300, 176, 188, 199, 271/204, 209, 280, 281, 307, 308

[56] References Cited

U.S. PATENT DOCUMENTS 3,284,081 11/1966 Huck ..... 271/300
3,672,265 6/1972 Schwarzkopf ..... 271/204
4,083,556 4/1978 Schilling ..... 271/204
4,235,434 11/1980 Müller ..... 271/280

FOREIGN PATENT DOCUMENTS 525679 10/1920 France ..... 271/209

*Primary Examiner*—Richard A. Schacher

*Attorney, Agent, or Firm*—Werner W. Kleeman

[57] ABSTRACT

Two stop or impact members which are situated opposite one another with respect to grippers of a conveyor device are used for detaching or removing the printed products out of their product formation. In their effective position these stop members project into the conveying path of the printed products. The printed products released by the grippers impact against the stop members and under the action of their own weight drop downwards. Viewed in the conveying direction the printed products are folded or bent into a substantially saddle-like configuration forwardly of the stop members, resulting in stiffening of the thus folded printed products, and after they impact against the stop members they can fall downwardly along a straight path. In order to appropriately kink or bend the printed products there is provided a substantially saddle-shaped support upon which come to bear the printed products at the region of their trailing edge, these printed products being retained approximately at their central region by the grippers at their leading edge. The printed products also can be released from the conveyed product formation or stream along a very short path even when the conveyor device is operating at high conveying speeds.

35 Claims, 5 Drawing Figures

APPARATUS FOR REMOVING FLEXIBLE FLAT PRODUCTS FROM A PRODUCT STREAM

CROSS REFERENCE TO RELATED CASE

This application is related to the commonly assigned, copending U.S. application Ser. No. 377,325, filed May 12, 1982, entitled "APPARATUS FOR STACKING FLAT PRODUCTS, ESPECIALLY PRINTED PRODUCTS ARRIVING IN AN IMBRICATED STREAM", and listing as the inventor WALTER REIST; and copending U.S. application Ser. No. 06/360,212, filed Mar. 22, 1982, entitled "APPARATUS FOR REMOVING FROM A PRODUCT STREAM CONVEYED BY MEANS OF A CONVEYOR DEVICE FLEXIBLE FLAT PRODUCTS, ESPECIALLY PRINTED PRODUCTS", and listing as the inventor WALTER REIST.

BACKGROUND OF THE INVENTION

The present invention relates to a new and improved construction of apparatus for the release of flexible, flat products, especially printed products from a conveyed product stream or formation, the printed products being retained by grippers of a conveyor device, wherein such grippers are attached in spaced relationship at a traction element.

Generally speaking, the product removal apparatus of the present development employs grippers of a conveyor device for retaining the products, these grippers being arranged in spaced relationship at a traction element. Also, there is provided at least one release device which can be switched-on and switched-off. The release device in its activated or switched-on state opens the grippers passing the release device.

It is known for the removal of printed products out of the conveyed product stream to arrange beneath the conveyor device a revolvingly driven transfer or take-over conveyor belt which exhibits the same conveying direction as the conveyor device and possesses a conveying speed or velocity which is however somewhat less than the conveyor device. Significant in this regard are German Patent Publication No. 2,752,513 and the corresponding British Pat. No. 1,568,752. The printed products which bear at the region of their trailing edge upon the transfer conveyor belt or band can detach from the opened grippers by virture of the lower velocity of the transfer conveyor belt. Following product release the printed products come to lie upon the transfer conveyor belt and are outfed by the latter. Particularly when encountering large conveying speeds of the conveyor device it is necessary that the transfer conveyor belt have a relatively long transfer or take-over run to ensure for the complete removal of the printed products. This rather long transfer run of the conveyor belt requires a correspondingly great amount of space.

SUMMARY OF THE INVENTION

Therefore, with the foregoing in mind, it is a primary objection of the present invention to provide a new and improved construction of apparatus for removing from a product stream conveyed by means of a conveyor device flexible flat products, especially printed products, in a manner which is not associated with the aforementioned drawbacks and shortcomings of the prior art discussed above.

Another and more specific object of the present invention aims at providing an apparatus of the character described which is of relatively simple construction and can be fabricated economically, and wherein even when operating at high conveying speeds of the conveying device it is possible to faultlessly release even extremely thin products from the product stream within an exceptionally short release path.

Yet a further significant object of the present invention aims at providing a new and improved construction of apparatus for the detachment of flexible flat products, especially although not exclusively printed products, from a product stream conveyed by means of a conveyor device, in a manner affording reliable removal of the products from the conveyed product stream in a protective manner and with the use of relatively simple means which can be positively brought, as desired, into an effectual product removal position or an ineffectual position where products are not removed from the product stream.

Yet a further significant object of the present invention aims at providing a product removal apparatus of the character mentioned above which is extremely reliable in operation, not readily subject to breakdown or malfunction, requires a minimum of maintenance and servicing, and is capable of perfecting reliable removal of products in a protective manner from a product stream even if conveyed at high speeds.

Now in order to implement these and still further objects of the invention, which will become more readily apparent as the description proceeds, the product removal apparatus of the present development is manifested by the features that there is provided at least one stop or impact member arranged at the region of the release device for the grippers. This stop member, upon switching-on and switching-off of the release device, can be inserted into or retracted out of the conveying path of the printed products.

The products which have been released by the grippers or gripper elements impact at their leading edge at the stop member which is introduced into the conveying path of the products in synchronism with the switching or turning-on of the release device. By means of this stop member the products released by the grippers are prevented from moving further in the conveying direction, which motion otherwise would be caused by their inertia. The products thereafter drop downwards under the the action of their own weight, or if desired, under the action of an additional force. The release of the products therefore can be accomplished along an extremely short path, in other words, practically at the site of the stop or impact member and in close proximity to the release device.

Each stop or impact member preferably possesses an impact surface which, in its effective introduced position, i.e., in a position inserted into the conveyed product stream, is directed away from the grippers, especially is moved downwardly, so that there is ensured for a still better detachment of the released products, especially at high conveying speeds of the conveyor device.

In order to ensure for a faultless entrainment of the products which impact at the moving stop or impact surface, it is advantageous to equip the stop surface with entrainment elements which, for instance, can be formed by teeth of a toothed belt.

In accordance with a particularly preferred constructional embodiment there are provided means for kinking or flexing the products, such kinking means being provided at a region of the conveying path of the products which is upstream or forward of the stop member.

Due to the kinking of the products the products which have arrived at the stop member have imparted thereto a stiffening action. This results in the products which have been released by the grippers, after they have impacted at the introduced stop member, immediately moving downwardly and essentially along a linear path under the action of the force of gravity. Consequently, it is possible to realize a faultless release of the products out of the conveyed product stream practically at the site of the stop or impact member, i.e., along an extremely short path. Also, there are not required the application of any additional forces in order to downwardly move the products.

The release of also extremely thin products is particularly then guaranteed if the products are folded or bent into a substantially saddle-shaped structure with the ridge or apex line of the thus folded product extending in the product conveying direction. In order to obtain a saddle-shaped configuration there is preferably arranged a saddle-shaped configured support forwardly of the stop member, viewed in the conveying direction of the products and below the conveyor device. The products which are retained by the grippers at their leading edge come to bear or repose upon the support or support means at least at the region of the trailing edge.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
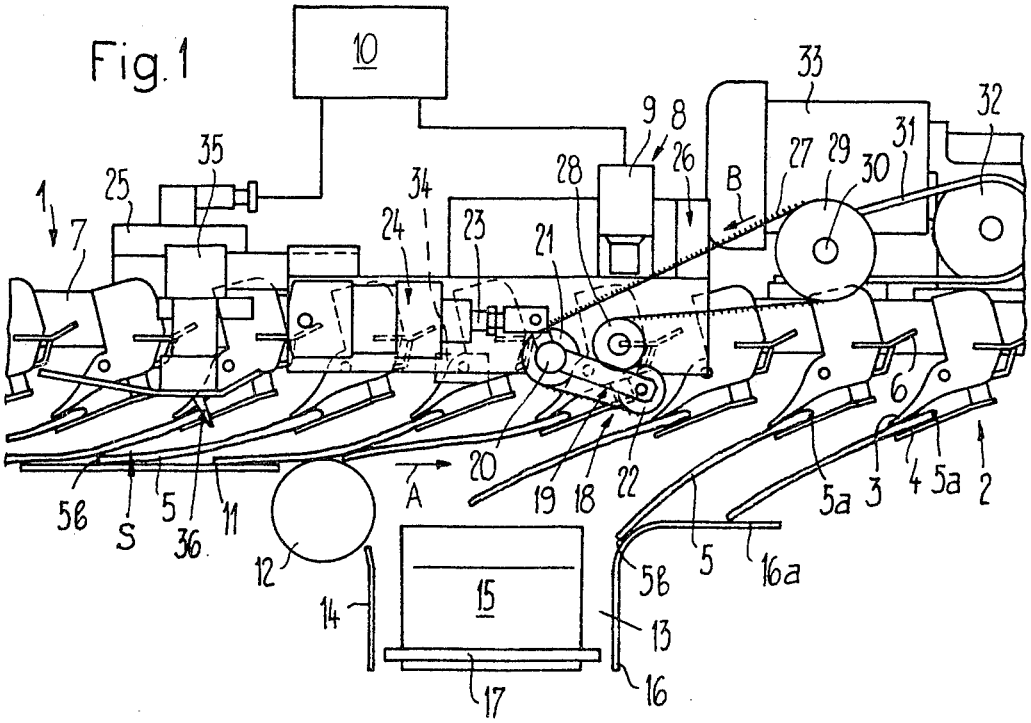
FIG. 1 illustrates a first exemplary embodiment of apparatus for releasing printed products from a product conveying stream, the products being conveyed in an imbricated or lapped formation, there being shown the release device in its turned-off condition and the stop or impact members in their retracted position, i.e., in an ineffectual position withdrawn from the conveying path of the products.
Figure 2:
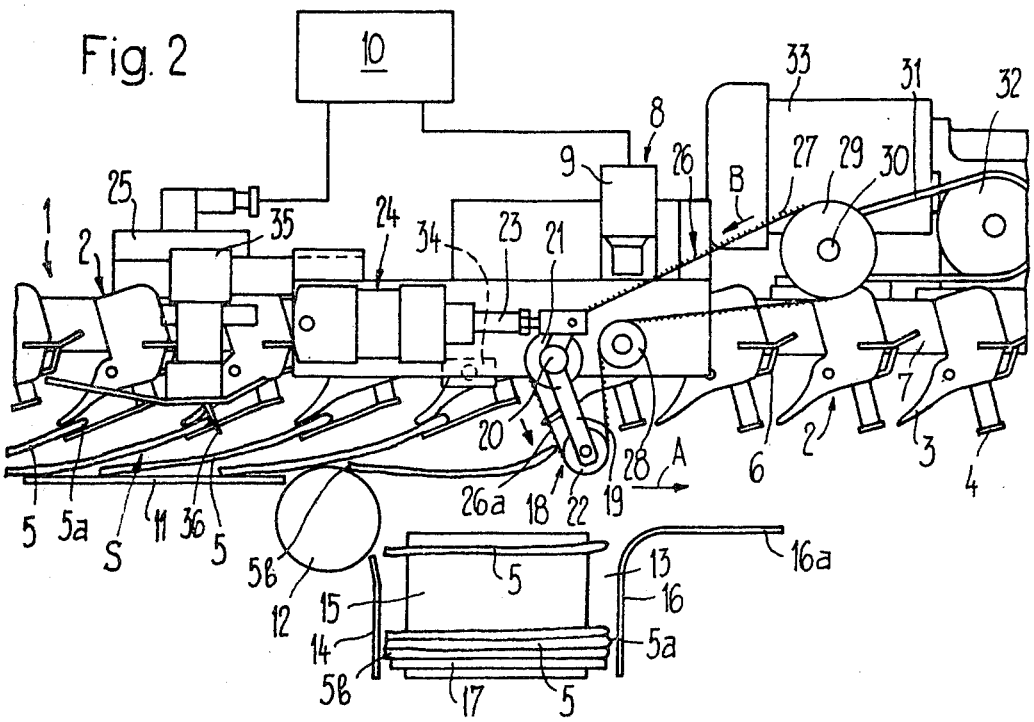
FIG. 2 illustrates the apparatus of FIG. 1 with the release device in its switched or turned-on condition and with the stop or impact members in their introduced or extended position where they are inserted into the product conveying path.

Describing now the drawings, it is to be understood that only enough of the construction of the product removal apparatus has been shown therein so as to simplify the illustration while still enabling those skilled in the art to readily understand the underlying principles and concepts of the present development. Turning attention now to FIGS. 1 and 2 there is illustrated therein a conveyor device, generally designated by reference character 1, this conveyor device corresponding both in its construction and mode of operation to the conveyor device described in detail in German Patent Publication No. 2,519,561 and the corresponding U.S. Pat. No. 3,955,667, granted May 11, 1976. Hence, since the details of such exemplary construction of conveyor device 1 are known to the art from the aforementioned patents it is unnecessary to further discuss herein the construction and operation of this conveyor device 1. As will be revealed by referring to FIGS. 1 and 2, the conveyor device 1 contains a number of grippers or gripper elements 2, each of which contains a fixed clamping tongue 3 and a moveable clamping tongue 4. When the grippers 2 are closed both of the clamping tongues 3 and 4 fixedly retain the printed products 5 at the region of their leading edge 5*a* (the so-called folding edge or product spine), as shown in FIG. 1. The moveable clamping tongue 4 is retained in its closed position by means of a blocking or latching element 6 or equivalent structure. These grippers or gripper elements 2 are attached at a here not particularly illustrated traction element which is revolvingly driven, and the grippers 2 are located in spaced relationship along such traction element which itself is guided within a channel 7 or other appropriate guide. Opening of the grippers 2 is accomplished by means of a release device or release means 8 which can comprise an electro-pneumatic directional control valve 9 which is operatively connected with a control device or control means 10. By means of the directional control valve 9 it is possible to raise and lower, as desired, a here not further shown control roll. In its lower end position this control roll has no effect upon the blocking or latching elements 6, so that the grippers 2 moving therepast are not open. On the other hand, if the control roll is in its upper end or terminal position, then it acts upon the blocking element 6 of the gripper or gripper elements 2 moving therepast, so that the moveable clamping tongues 4 are unlocked and pivoted into their open position. The printed products 5 are thus released, as has been shown in FIG. 2.

Below the conveyor device 1 and located in its conveying direction A forwardly of the release device 8 is a support element 11, here shown as a support rail, at which follows a rotatably mounted roll 12. The printed products 5 come to bear upon the support rail 11 and the roll 12 at their trailing edges 5*b*, as the same has been indicated in FIGS. 1 and 2. Positioned after and in close proximity to the support arrangement 11, 12 constituted by the support rail 11 and the support roll 12 is a product stacker or stacking chute 13 which is defined by the guides or guide members 14, 15 and 16. The guide member 16 possesses a product support portion or part 16*a* for the printed products 5, this support portion 16*a* extending in the product conveying direction A. The stacking chute 13 is closed at its lower end by an elevationally displaceable support table 17 or equivalent support structure.

Two stop or impact members 18 are provided above the stacking chute 13 and at the region of the release device 8. These stop members are located opposite one another with respect to the channel 7 and only one such stop or impact member 8 is visible in the showing of FIGS. 1 and 2. Each stop or impact member 18 possesses a double-arm lever 19 which is pivotably mounted for movement about a stationary pivot pin 20 defining a pivot axis. At the ends of the longer arm of the double-arm lever 19 there are provided two deflection rolls 21 and 22. The one deflection roll 21 is mounted upon the pivot pin or shaft 20, whereas the other deflection roll 22 is arranged at the free end of the longer arm of the double-arm lever 19. At the shorter arm of the double-arm lever 19 there engages the piston rod 23 of a pneumatic piston-and-cylinder unit 24 which is connected with the channel 7 or the like. This piston-and-cylinder unit 24 is controlled by means of an electro-pneumatic 5/2—directional control valve 25 which is coupled with the control device or control means 10. A toothed belt 26 is guided over both of the deflection rolls 21 and 22 of each double-arm lever 19. The teeth 27 of the just-mentioned belt 26 are arranged at the outer face or side of such toothed belt 26, as has only been schematically represented in FIGS. 1 and 2. The toothed belt 26 is also guided over a stationary deflection roll 28 and a drive pulley or wheel 29. The drive pulleys or wheels 29 for the toothed belts 26 located at both sides of the channel 7 are seated upon a common shaft 30 which is in drive connection by means of a V-belt 31 or equivalent power transmitting element with a drive wheel or pulley 32. The drive pulley 32 or equivalent structure is driven by means of a drive motor 33 attached to the channel 7. Additionally, each toothed belt 26 travels over a not particularly illustrated belt tensioning device which may be of conventional design and maintains the toothed belts 26 in a taut condition.

By means of the drive motor 33 the toothed belts 26 are revolvingly driven in the direction of the arrow B. The belt run **26*a* of each toothed belt 26 which is located between the deflection rolls 21 and 22 thus forms a stop or impact surface for the printed products 5** in a manner still to be described in greater detail hereinafter.

At the underside of the channel 7 there is arranged a conventional proximity switch 34 or equivalent structure, which is responsive to the grippers 2 and upon movement of each gripper therepast generates a clock pulse which is inputted to the control means or device 10. By means of the clock pulses generated by the proximity switch 34 there is fixed the control cycle or clock.

Moreover, a conventional counter 35 is attached at the channel 7. This counter 35 possesses a finger 36 or like protuberance which protrudes into the conveying path of the printed products 5. This finger 36 is activated by the leading edges **5*a* of the printed products 5 moving therepast and upon each actuation of such finger 36 there is produced a counting pulse which likewise is inputted to the control means 10**.

The mode of operation of the described product release apparatus is as follows:

In FIG. 1 the release device or release means 8 has been depicted in its turned or switched-off condition. That means that the control roll of the release device 8 is located in its lower inactive position. At the same time the piston rod 23 of each piston-and-cylinder unit 24 is completely retracted, so that the double-arm lever 19 is located in its upper end or terminal position where it has been pivoted out of the conveying path of the printed products 5. The toothed belts 26 are driven. With the release device 8 turned-off and the double-arm levers 19 pivoted upwardly, i.e., pivoted out of the product conveying path A, the printed products 5 travel past the release device 8 and past the stop or impact members 18, as apparent from the illustration of FIG. 1.

Now if printed products 5 are to be removed out of the imbricated or lapped product formation S and stacked in the stacker device 13, then the release device 8 is switched-on and in synchronism therewith the stops or impact members 18 are introduced into the conveying path. With the command "remove products" the control device 10 produces synchronized control commands for the directional control valves 9 and 25 in response to the clock pulses produced by the proximity switch 17. Since the double-arm levers 19, at the point in time of such clock pulse, must be pivoted into the product conveying path, the control command for the directional control valve 25 must be generated at a point in time prior to such clock pulse and in accordance with the amount of time needed for the pivoting-in of each such double-arm lever 19. The control command for the directional control valve 9 is produced after a certain interval following such clock pulse, in order to take into account that the release device 8, viewed in the product conveying direction A, is arranged at a certain spacing behind the double-arm levers 19. By means of the control command produced by the control device 10 the directional control valves 9 and 25 are switched. As a consequence thereof the control roll of the release device 8 is brought into its upper terminal position and the piston rods 23 of the piston-and-cylinder units 24 are extended. Due to such extension or outward thrusting of the piston rods 23 the double-arm levers 19 are pivoted from their upper terminal position downwardly into their effective position where they protrude into the conveying path A of the printed products 5, as best seen by referring to FIG. 2. By means of the control device 10 there is ensured in the previously described manner that the release device or release means 8 will be turned-on and the stops or impact members 18 will be pivoted into the product conveying stream A in synchronism with one another.

By means of the release device 8 the grippers 2 moving therepast are opened in the previously described manner. The thus released printed products 5 impact by means of their leading edge **5*a* at the impact or stop surface 26*a* which, as already explained, is formed by the belt run of the toothed belt 26 located between the deflection rolls 21 and 22. Since the toothed belts 26 are driven in the direction of the arrow B, each such stop or impact surface 26*a* moved downwardly as has been illustrated in FIG. 2. Due to this downward movement the printed products 5 are moved downwardly towards the stacker chute 13 at the region of their leading edge 5*a*. By the action of the belt teeth 27 which confront the arriving printed products 5 there is ensured for a faultless entrainment of such printed products 5**.

As will be seen by reverting to FIG. 2, the spacing between the stop or impact surface **26*a*, with the related lever 19 pivoted-in, and the end of the support arrangement 11, 12 formed by the support rail 11 and the support roll 12, is smaller than the spacing between the leading edge 5*a* and the trailing edge 5*b* of the printed products 5. This means that the printed products 5, at the moment that they impact against the impact or stop surfaces 26*a*, still bear by means of their trailing edge 5*b* upon the support roll 12. This trailing product edge 5*b* is first then released when the leading product edge 5*a* has experienced a downwardly directly acceleration which is imparted thereto by the revolving toothed belts 26. In this way there is ensured that the printed products 5 will drop in approximately horizontal position into the stacker chute 13 where they are stacked in conventional fashion on the support table 17**.

The desired number or printed products within a stack is inputted to a counting device of the control means 10. The counter 35, as explained, generates a counting pulse for each printed product 5 moving therepast, each such counting pulse being delivered to such counting device within the control means 10. These counting pulses initiate a backwards or down counting of the counting device. Once the counting device has reached the counter state 0, then the control device 10 produces control commands by means of which there are switched the directional control valves 9 and 25. The release device 8 is turned-off and the double-arm lever 19 is again upwardly pivoted out of the product conveying stream A due to retraction of the piston rod 23 into its related cylinder. The grippers or gripper elements 2 are no longer opened, as the same has been explained in conjunction with the prior description of FIG. 1. The finished-formed stack is then removed in conventional fashion out of the stacker chute 13 and delivered to a further processing station.

By virtue of the action of the impact or stop members 18 which are pivoted into the product conveying path A of the printed products 5 and again out of such product conveying path, it is possible to release along an extremely short path printed products out of the imbricated product formation. By virtue of the revolving toothed belts 26, with the stops or stop members 18 in their pivoted-in position, the printed products 5 released by the grippers 2 are downwardly accelerated, so that this product release action also is ensured for along a short path even if the conveyor device 1 has an appreciable conveying velocity and conveying output.

The previously explained product release apparatus can be differently constructed as to a number of components or parts thereof than illustrated herein by way of example and not limitation. In the description to follow there will be considered several such possible variations.

Under circumstances it is conceivable to use only a single stop or impact member 18. Additionally, the toothed belts 26 also can be guided and driven in a manner different than illustrated. Instead of using toothed belts 26 there could be employed other suitable band or belt-like elements which possess, instead of the belt teeth 27 other constructed entrainment elements. Instead of employing protruding entrainment elements the belt or band also could be provided with an adhesive coating. The stop or impact member or members 18 also can be structured so that they can be inserted with a translatory movement into the product conveying stream A.

Although the movement of the impact or stop surfaces **26*a* downwardly is significant to achieve a faultless release of the printed products 5, nonetheless it is conceivable, with certain designs of the apparatus, to structure these impact or stop surfaces 26*a* so as to be stationary. With such stationary impact surfaces 26*a*** there exists, however, the danger that the printed products impacting thereagainst will not readily drop downwards. It is for this reason that, under circumstances, it is necessary to provide additional means, for instance to exert a blowing action by means of an air current, in order to impart a downwards acceleration to the printed products.

The release device 8 and the impact or stop members 18—sometimes simply referred to herein as stops—can be actuated hydraulically or in any other suitable manner instead of pneumatically.

Also it is possible to use conveyor devices of different construction than herein disclosed by way of example. For instance there can be employed a conveyor device as the same has been described in German Patent Publication No. 3,102,242 and the corresponding commonly assigned, copending U.S. application Ser. No. 06/225,420, filed Jan. 15, 1981, now U.S. Pat. No. 4,381,056, granted Apr. 26, 1983. In the last-mentioned instance it is advantageous to drive the roll 12. The described equipment also then can be employed when each gripper 2 retains two or more printed products.

Equally, it is possible to provide a plurality of transfer or outfeed locations for the printed products 5 which, viewed in the direction of product conveying A, are arranged behind one another or in tandem, as the same has been disclosed for instance in the previously mentioned German Patent Publication No. 2,752,513 and the cognate British Pat. No. 1,568,752. At each of these transfer locations or stations there would then be provided a release device 8 and at least one stop 18 in the manner described above predicated upon the disclosure of FIGS. 1 and 2.

It should be understood that the printed products 5 which are released from the imbricated product formation S need not absolutely be stacked. Thus, for instance, it would be possible to deposit the removed printed products 5 upon a conveyor belt and to outfeed such in an imbricated or lapped formation for further processing. The printed products 5 also can be conveyed in a different formation than in the imbricated product stream or array S.

Since the printed products 5, upon impact at the stop or impact surfaces **26*a*, are subjected to the action of a force, the described apparatus can not simply be used as such for handling thin individual sheets, since when processing such individual sheets there exists the danger of damaging the same. Therefore, this equipment is preferably utilized for processing multi-sheet printed products, and specifically, folded, bound or stitched products which are conveyed with the edge thereof where the sheets are interconnected with one another leading. The equipment is particularly suitable for removing single-folded and double-folded printed products 5** in the described manner out of the conveyed product stream.

Figure 3:
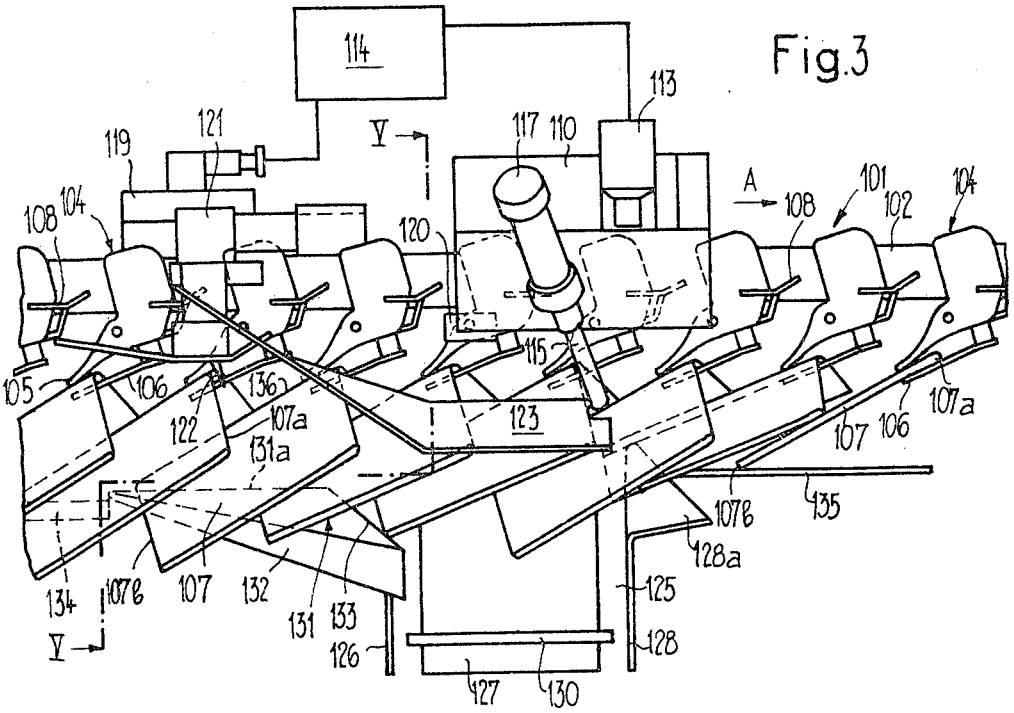
FIG. 3 is a side view of a second exemplary embodiment for releasing printed products conveyed in an imbricated or lapped formation out of the product conveying stream and with the release device shown in its switched-off condition and the stop or impact members in their retracted position.
Figure 4:
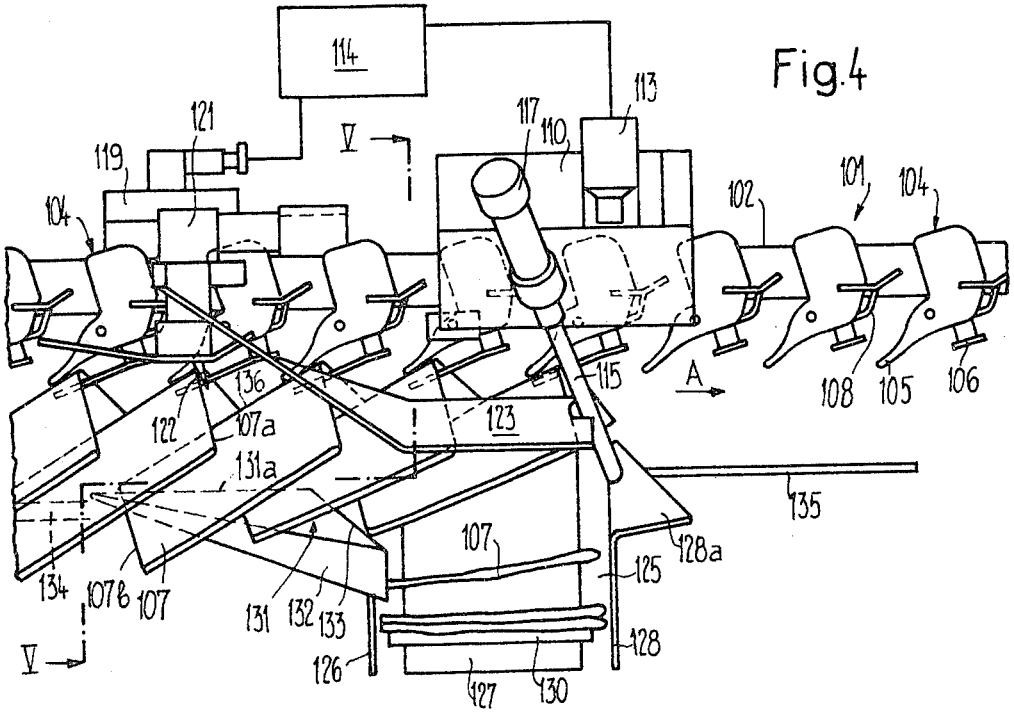
FIG. 4 illustrates the product release apparatus of FIG. 3 with the release device switched-on and the stop or impact members in their extended or introduced position where they dip into the product conveying path.
Figure 5:
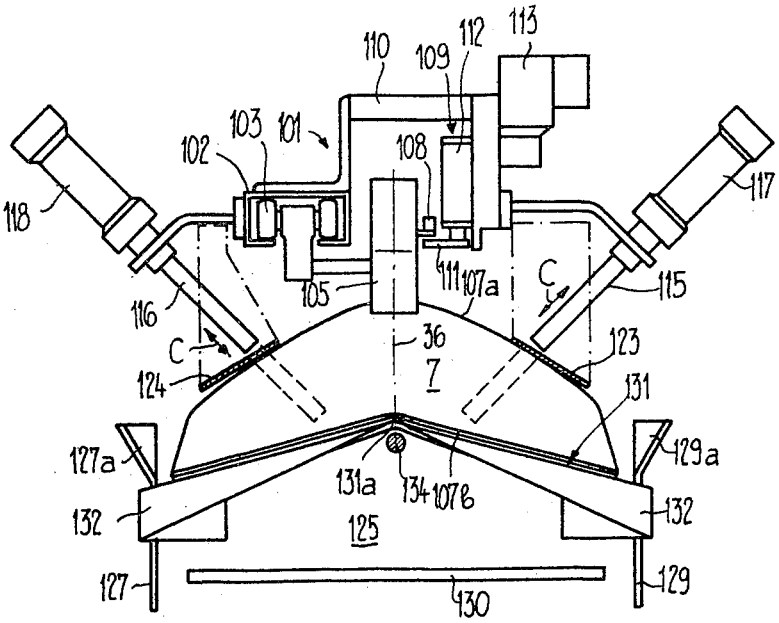
FIG. 5 is a cross-sectional view of the second embodiment of release apparatus, taken substantially along the line V—V of FIGS. 3 and 4.

In the description to follow there will now be considered in detail a second exemplary embodiment of the invention in conjunction with FIGS. 3, 4 and 5.

The conveyor device illustrated in such FIGS. 3, 4 and 5, and generally designated by reference character 101, likewise may be constructed like the conveyor device described in detail in the mentioned German Patent Publication No. 2,519,561 and the corresponding U.S. Pat. No. 3,955,667, to which reference may be readily had and the disclosure of which is incorporated herein by reference. It is for this reason that in the discussion to follow it is unnecessary to consider the construction and mode of operation of this known conveyor device 101. Such conveyor device 101 possesses a chain 103 or equivalent structure which is guided within a channel 102. Secured to the chain 103 in spaced relationship therealong are grippers or gripper elements 104. The chain 103 can be constructed in the manner described in Swiss Pat. No. 588,647 and the corresponding British Pat. No. 1,549,283. Each gripper or gripper element 104 possesses a stationary or fixed clamping tongue 105 and a moveable clamping tongue 106 coacting with the fixed clamping tongue 105. When the grippers 104 are in their closed position both of the clamping tongues 105 and 106 retain the printed products 107 at the region of their leading edge 107*a* (the so-called folding edge or spine). The moveable clamping tongue 106 is retained in its closed position by means of a blocking or latching element 108. Opening of the grippers 104 is accomplished by means of a release device 109 (FIG. 5), which is mounted at a holder or support means 110 attached to the channel 102. This release device or release means 109 possesses a control element 111 which can be raised and lowered by means of a pneumatic piston-and-cylinder unit 112. The piston-and-cylinder unit 112 is actuated by means of an electro-pneumatic displacement control valve 113 which is connected with a here not particularly illustrated but standard compressed air connection or line. This displacement control valve 113 is operatively connected with a control device or control means 114. In its lower terminal position, as illustrated in FIG. 5, the control element 111 is not in operative engagement with the blocking or latching element 108, so that the grippers 104 moving past the control element 111 are not opened (FIG. 3). On the other hand, if this control element 111 is located in its upper end or terminal position, then it acts upon the blocking or latching elements 108 of the grippers 104, so that the moveable clamping tongues 106 are unlocked and pivoted into their open position. The printed products 107 are then released, as the same has been illustrated in FIG. 4.

At the region of the release device 109 there are arranged two substantially rod-shaped stops or impact members 115 and 116 which are arranged opposite one another in relation to the grippers or gripper elements 104. Each of these stops or impact members 115 and 116 is drivingly connected with a pneumatic piston-and-cylinder unit 117 and 118, respectively. By means of the associated piston-and-cylinder unit 117 and 118 these rod-shaped stops or impact members 115 and 116 are displaced in the direction of their lengthwise axis, i.e., in the direction of the double-headed arrow C. The piston-and-cylinder units 117 and 118 are connected by means of any suitable connection line with an electro-pneumatic displacement control valve 119, which likewise is connected with the control device 114 and attached at the channel 102. Additionally, this displacement control valve 119 is operatively coupled with a here not particularly illustrated, but conventional source of compressed air. In FIGS. 3 and 5 the impact or stop members 115 and 116 have been depicted in their retracted position where they are located externally of the conveying path A of the printed products 107. FIG. 4 shows the impact or stop members 115 and 116 in their introduced or extended position where they protrude into the aforementioned product conveying path. This introduced or extended position has been shown in FIG. 5 in broken or phantom lines.

At the underside of the channel 102 there is arranged a conventional proximity switch 120 or equivalent structure which, upon each gripper 104 moving therepast, generates a clock pulse which is inputted to the control device 114. By means of the pulses produced by the proximity switch 120 there is determined or fixed the control cycle or clock.

Additionally, a suitable counter 121 of known design is mounted at the channel 102. This counter 121 possesses a finger 122 or equivalent protruding or actuatable element which extends into the product conveying path A of the printed products 107. This finger 122 is activated by the edges 107*a* of the printed products 107 moving past such finger 122 and each time that the finger 122 is actuated there is produced a counting pulse which likewise is inputted to the control device 114.

Viewed in the conveying direction A of the conveyor device 101 there is arranged forwardly of each stop or impact member 115 and 116 a guide element 123 and 124, respectively, which covers the related stop member 115 and 116 in its retracted position and ensures that none of the printed products 107 will impact against the stop members 115 and 116 located in their retracted position.

Below the stop or impact members 115 and 116 there is arranged a product stacking or stacker chute 125 which is formed or defined by the chute walls 126, 127, 128 and 129. To prevent damage to the printed products 107 the chute walls 127, 128 and 129 are bent or flexed at the region of their upper corners 127*a*, 128*a* and 129*a*, respectively. The stacker chute 125 is closed at its lower end or region by an elevationally displaceable, i.e., up and down moveable support table 130.

Viewed in the product conveying direction A there is arranged forwardly of such stacker chute 125 a substantially ridged or saddle-shaped support element 131 for the printed products 107. The ridge line 131*a* of such saddle roof-like configured support element 131 extends essentially parallel to the conveying direction A. The support element 131 is equipped with side portions 132 extending in vertical direction. The support element 131 terminates at a spacing from the stops or impact members 115 and 116 located in the inserted position and possesses at such end confronting the stop or impact members 115 and 116 edges 133 which extend obliquely downwardly. The saddle-shaped or saddle roof-like support element 131 is arranged upstream of a substantially rod-shaped support element 134 which essentially is in alignment with the ridge or apex line 131*a* of the support element 131.

Also viewed in the product conveying direction A there merges at the stacker chute 125 a support portion or element 135 for the printed products 107 which travel past the stacker chute 125. This support portion or element 135 can be of random design and, for instance, can consist of two mutually parallel rods. However, it is also possible to use only a single rod.

The mode of operation of the described embodiment of product removal apparatus of FIGS. 3 to 5 is as follows:

As these FIGS. 3, 4 and 5 illustrate, the printed products 107 are retained at their leading edges 107*a* by the grippers 104 approximately at the central region of the related printed products. As soon as the printed products 107 come to bear upon the rod-shaped support element 134 at the region of their trailing edges 107*b* these products are kinked or bent about a kink or bending line 136 which extends essentially in the product conveying direction A. The printed products 107 therefore have imparted thereto a saddle-like or saddle roof-like configuration as will be clearly apparent from the drawings. Thereafter, the printed products 107 come to bear upon the saddle-shaped support element 131 so that there is imparted a defined saddle-like configuration to the printed products 107. Due to this kinking or bending of the products about the line 136 there is caused a stiffening of the printed products 107. This product stiffening action is of great importance for the release operation which will still be described in greater detail hereinafter.

Now in FIGS. 3 and 5 the release means or release device 109 has been shown in its turned-off condition. This means that the control element 111 is located in its lower inactive position where, as mentioned, it is without effect upon the blocking elements 108 of the grippers 104. At the same time the impact or stop members 115 and 116 are completely in their retracted position, so that they are located externally of the conveying path of the printed products 107. The grippers 104 travel, without being opened, past the release device 109 and transport the printed products 107 below the stop members 115 and 116 and over and past the stacker chute 125, as shown in FIG. 3.

Now if printed products 107 should be released or detached out of the imbricated or lapped product formation and stacked in the stacker chute 125, then the release device 109 must be turned-on and the stop members 115 and 116 introduced into the product conveying path A. By means of a command "release the products" the control device 114 produces, in accordance with the clock pulses generated by the proximity switch 120, synchronized control commands for the displacement control valves 113 and 119, and there is taken into account that the release device 109, viewed in the product conveying direction A, is arranged at a certain spacing behind the stop or impact members 115 and 116. By means of the control commands produced by the control device 114 the displacement control valves 113 and 119 are switched. As a consequence thereof the control element 111 of the release device 109 is placed into its upper terminal or end position and the stop members 115 and 116 are moved downwardly, in the direction of the arrow C, into their effective position where they protrude into the product conveying path A, as has been indicated in FIG. 4. By means of the control device 114 there is ensured that the turning-on of the release device 109 and the extension or introduction of the stop or impact members 115 and 116 into the product conveying stream is accomplished in synchronism to one another.

By means of the release device 109 the grippers 104 moving therepast are opened in the already described manner. Consequently, the printed products 107 are released, which now bear by means of their leading edges 107*a* at the impact or stop members 115 and 116. At the moment of impact the printed products 107 no longer bear upon the support element 131, but however still possess their saddle-shaped configuration. As best seen by referring to FIG. 4, a rebound of the printed products 107 which have impacted at the stop members 115 and 116 is prevented in that the printed products bear by means of their trailing edges 107*b* at the inclined or obliquely extending edges 133 of the support element 131. The released printed products 107 fall, under the action of their weight, downwardly into the stacker chute 125 and come into reposing contact with the support table 130 or printed products which are already located upon such support table 130. The saddle-shaped configuration of the printed products 107 results in a stabilization of the movement of the printed products 107 during their free fall into the stacker chute 125. This has a particularly advantageous effect when handling thin products having the tendency, during their free fall, of performing a rocking motion. By virtue of this stabilization of the suspension movement of the printed products 107 there is realized the beneficial result that these printed products drop downwardly essentially along a straight line or linear path of travel. Consequently, it is possible to stack the printed products 107 upon one another in an aligned condition. Particular measures or equipment for the alignment of the stack therefore can be limited or even completely dispensed with.

The roof-shaped configuration of the printed products 107 afford still further benefits. In a top plan projection the printed products 107 when in their saddle-like shape occupy a smaller area than the area occupied when the printed products are spread out in the plane of a top plan view of such printed products. Consequently, the products released by the grippers 104 can be introduced without any difficulty between the chute walls 126, 127, 128 and 129 of the stacker chute 125. During the course of the falling motion of the printed products both valves of the printed products 107 which have been bent along the fold or bending line 136 and originally form an angle with one another are again upwardly pivoted in a common plane. Consequently, the printed products 107 arrive with their side edges in contact with the chute walls 126, 127, 128 and 129 so that there is realized a beneficial guiding and alignment of the printed products 107. There is accomplished a faultless formation of the product stack independent of the thickness of the printed products 107.

As already explained the counter 21, during such time as each printed products 107 moves past, generates a counting pulse which is infed to a counting device of the control device or control means 114. The desired number of printed products per stack is inputted into the mentioned counting device. The counting pulses cause a rearwards or down counting of this counting device. If the latter has reached the counter state null, then control commands are produced in the control device 114 which cause the displacement control valves 113 and 119 to switch. The release device 108 is switched, and the stop or impact members 115 and 116 are again moved upwardly out of the product conveying stream A. The grippers 104 therefore travel together with the printed products 107 retained thereat past the stacker chute 125 which then can be emptied in conventional manner.

The stiffening of the products which is caused by the bending of the printed products 107 about a line 136 extending essentially in the product conveying direction A, before impingement of the products against the stop or impact members 115 and 116, and the saddle-shaped product configuration obtained in this manner, afford the beneficial result that after release of the printed products 107 they tend to fall under the action of their inherent weight along an essentially linear path downwardly into the stacker chute 125. Hence, the printed products 107 can be released and outfed from the product formation at the location where they are freed by the grippers 104.

The previously described product removal apparatus can be, of course, also modified as to a number of aspects or parts thereof and can be constructed differently than has been illustrated by way of example and not limitation. At this juncture there will be explained several of such possible modifications which can be readily made.

A simple and reliable kinking or bending of the printed products is possible in the manner described in conjunction with FIGS. 3, 4 and 5 above. Yet, it is also conceivable to kink or bend the printed products through the use of other means or in a different manner. The support rod or element 134 which is arranged upstream or forwardly of the saddle roof-like configured support element 131, and which support rod causes a pre-bending or pre-kinking of the printed products, can also be dispensed with under circumstances. Additionally, during certain fields of application the saddle-like or saddle roof-like configured support element 131 can be replaced by a support rod which corresponds to the support element 134.

The release device 109 and the stop or impact members 115 and 116 can be also operated, instead of pneumatically, also hydraulically or in a different manner. Equally, there can be employed other constructions of conveyor devices, thus for instance a conveyor device as has been described in the aforementioned German Patent Publication No. 3,102,242 and the corresponding U.S. patent application Ser. No. 06/225,420, filed Jan. 15, 1981, now U.S. Pat. No. 4,381,056, granted Apr. 26, 1983, to which reference may be readily had and the disclosure of which is incorporated herein by reference. Each gripper 104 also can retain two or more printed products 107.

Furthermore, there can be provided a number of transfer or delivery locations for the printed products 107 which are arranged behind one another in the conveying direction A, as has been disclosed in the already referred to German Patent Publication No. 2,752,513 and the cognate British Pat. No. 1,568,752. At each of these transfer locations there would be then provided a release device 109 and stop or impact members 115 and 116. Since, as already mentioned, the printed products 107 can be released from the product conveying stream along a very short path, it is possible to arrange these transfer or delivery locations in close proximity behind one another. It should be understood that the printed products 107 which have been removed from the imbricated or lapped product formation need not be absolutely stacked. Thus, for instance, it would be possible to deposit the removed printed products 107, instead of upon a support table 130, upon a conveyor belt or band which is located below the stack chute formed by the chute walls 126, 127, 128 and 129.

Since, as already explained, the printed products experience a reinforcement or stiffening by the exerted bending action, it is possible to process with the described equipment also thin products and individual sheets, since by virtue of such stiffening such thin products will not be damaged upon impact at the stop or impact members 115 and 116.

Finally, it is still further to be mentioned that with both of the described exemplary embodiments of product removal apparatus as disclosed herein it would be possible to detach from the product conveying stream or formation also flexible, flat products other than printed products.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for the removal of flexible, flat products, especially printed products, from a product conveying stream moving in a predetermined product conveying direction and defining a product conveying path, comprising:

a conveyor device;

said conveyor device being provided with gripper elements arranged in spaced relationship from one another at said conveyor device;

at least one release device which can be selectively switched-on and switched-off;

said release device, when assuming its switched-on condition, opening the gripper elements moving therepast;

at least one stop means arranged at the region of the release device which upon switching-on and switching-off the release device can be respectively introduced into and retracted from the product conveying path for the products;

each said stop means comprises an impact surface which is moved in a direction away from the gripper elements when said stop means is introduced into the product conveying path; and said impact surface is defined by a portion of a revolvingly driven band.

2. The apparatus as defined in claim 1, further including:

means for introducing and retracting the stop means synchronously with the switching-on and switching-off of the release device.

3. The apparatus as defined in claim 1, wherein:

said impact surface is moved downwardly.

4. The apparatus as defined in claim 1, wherein:

said impact surface is provided with entrainment elements.

5. The apparatus as defined in claim 4, wherein:

said band comprises a toothed belt having teeth defining said entrainment elements and confronting the arriving printed products.

6. The apparatus as defined in claim 1, further including:

a support arrangement located, viewed with respect to the direction of conveying of the products, forwardly of said stop means and below said conveyor device;

said conveyor device extending essentially in horizontal direction; and said printed products which are retained at their leading edges by the gripper elements bearing by means of their trailing edges upon said support arrangement.

7. The apparatus as defined in claim 6, wherein:

said support arrangement terminates in spaced relationship from said stop means when located in its introduced position in the product conveying path at a spacing which is smaller than the distance between the leading and trailing edges of the printed products.

8. The apparatus as defined in claim 7, wherein:

said support arrangement comprises a substantially planar support element and a support roll rotatably mounted at a location following said support element.

9. The apparatus as defined in claim 6, wherein:

said support arrangement comprises a substantially planar support element and a support roll rotatably mounted at a location following said support element.

10. The apparatus as defined in claim 8, wherein:

said support roll comprises a driven roll.

11. The apparatus as defined in claim 6, further including:

chute means for receiving the released products located below said stop means and following said support arrangement.

12. The apparatus as defined in claim 11, wherein:

said chute means is structured as a stacker chute which is closed at its lower end by a support table.

13. The apparatus as defined in claim 1, further including: means for pivotably mounting said stop means.

14. An apparatus for the removal of flexible, flat products, especially printed products, from a product conveying stream moving in a predetermined product conveying direction and defining a product conveying path, comprising:

a conveyor device;

said conveyor device being provided with gripper elements arranged in spaced relationship from one another at said conveyor device;

at least one release device which can be selectively switched-on and switched-off;

said release device, when assuming its switched-on condition, opening the gripper elements moving therepast;

at least one stop means arranged at the region of the release device which upon switching-on and switching-off the release device can be respectively introduced into and retracted from the product conveying path for the products;

each said stop means comprises an impact surface which is moved in a direction away from the gripper elements when said stop means is introduced into the product conveying path;

said impact surface is provided with entrainment elements; and said impact surface comprises at least a portion of a revolvingly driven band constituted by a toothed belt having teeth defining said entrainment elements and confronting the arriving printed products.

15. An apparatus for the removal of flexible, flat products, especially printed products, from a product conveying stream moving in a predetermined product conveying direction and defining a product conveying path, comprising:

a conveyor device;

said conveyor device being provided with gripper elements arranged in spaced relationship from one another at said conveyor device;

at least one release device which can be selctively switched-on and switched-off;

said release device, when assuming its switched-on condition, opening the gripper elements moving therepast;

at least one stop means arranged at the region of the release device which upon switching-on and switching-off the release device can be respectively introduced into and retracted from the product conveying path for the products;

means for pivotably mounting said stop means;

each stop means comprises a moved impact surface;

said impact surface being defined by a run of a belt;

a pair of deflection rolls between which there is situated said belt run;

a pivotal lever having a free end; and one of said deflection rolls being mounted at the region of said free end of said pivotal lever.

16. An apparatus for the removal of flexible, flat products, especially printed products, from a product conveying stream moving in a predetermined product conveying direction and defining a product conveying path, comprising:

a conveyor device;

said conveyor device being provided with gripper elements arranged in spaced relationship from one another at said conveyor device;

at least one release device which can be selectively switched-on and switched-off;

said release device, when assuming its switched-on condition, opening the gripper elements moving therepast;

at least one stop means arranged at the region of the release device which upon switching-on and switching-off the release device can be respectively introduced into and retracted from the product conveying path for the products; and means for kinking the printed products at the region of the product conveying path and located upstream of said stop means.

17. The apparatus as defined in claim 16, wherein:

said means for kinking said products serves to bend said products into a substantially saddle-shaped configuration about a line extending essentially in the direction of conveying of the products.

18. The apparatus as defined in claim 17, further including:

support means arranged forwardly of said stop means and below said conveyor device, viewed in the direction of conveying of the products; and said support means serving to support the products which are retained by the gripper elements at their leading edges at least at the region of the trailing edges of said products.

19. The apparatus as defined in claim 18, wherein:

said support means terminates at a spacing forwardly of said stop means located in its introduced position into the product conveying path.

20. The apparatus as defined in claims 18 or 19, wherein:

said support means possesses a substantially saddle-shaped configuration.

21. The apparatus as defined in claims 18 or 19, wherein:

said support means possesses a substantially rod-shaped configuration.

22. The apparatus as defined in claim 20, wherein:

said support means is provided at an end thereof confronting said stop means with an inclined portion extending in the product conveying direction away from said conveyor device.

23. The apparatus as defined in claim 20, further including:

a substantially rod-shaped support element arranged forwardly of the saddle-shaped support means, viewed in the direction of conveying of the printed products;

said saddle-shaped support means having a ridge line; and said rod-shaped support element essentially being in alignment with said ridge line of said support means.

24. The apparatus as defined in claim 18, further including:

chute means arranged, following said support means, below said stop means and serving for the reception of the released products.

25. The apparatus as defined in claim 24, wherein:

said chute means is structured as a stacker chute which is closed at its lower end by closure means.

26. The apparatus as defined in claim 25, wherein:

said closure means comprises an elevationally displaceable product support table.

27. The apparatus as defined in claim 16, wherein:

at least two of said stop means are associated with said release device and arranged opposite one another in relation to said gripper elements.

28. The apparatus as defined in claim 27, further including:

fluid-operated drive means provided for each of said stop means in order to introduce and retract said stop means with respect to the product conveying path.

29. The apparatus as defined in claim 28, wherein:

said fluid-operated drive means comprises hydraulic drive means.

30. The apparatus as defined in claim 28, wherein:

said fluid-operated drive means comprises pneumatic drive means.

31. The apparatus as defined in claim 28, wherein:

said release device comprises a fluid-operated release device;

respective control valve means provided for said release device and for said drive means for said stop means; and a common control means with which there are operatively connected said respective control valve means.

32. An apparatus for the removal of flexible, flat products, especially printed products, from a product conveying stream moving in a pedetermined product conveying direction and defining a product conveying path, comprising:

a conveyor device;

said conveyor device being provided with gripper elements arranged in spaced relationship from one another at said conveyor device;

at least one release device which can be selectively switched-on and switched-off;

said release device, when assuming its switched-on condition, opening the gripper elements moving therepast;

at least one stop means arranged at the region of the release device which upon switcing-on and switching-off the release device can be respectively introduced into and retracted from the product conveying path for the products;

means for kinking the printed products at the region of the product conveying path and located upstream of said stop means;

a guide element arranged, viewed with respect to the direction of conveying of the products, forwardly of said stop means and covering said stop means in its introduced position; and said guide element serving for guiding the products.

33. The apparatus as defined in claim 16, wherein:

said means for kinking the printed products exerts a stiffening action upon such kinked printed products, so that the products released by the grippers move downwardly and essentially along a linear path under the action of the force of gravity.

34. An apparatus for the removal of flexible, flat products, especially printed products, from a product conveying stream moving in a predetermined product conveying direction and defining a product conveying path, comprising:

a conveyor device;

said conveyor device being provided with gripper elements arranged in spaced relationship from one another at said conveyor device;

at least one release device which can be selectively switched-on and switched-off;

said release device, when assuming its switched-on condition, opening the gripper elements moving therepast;

at least one stop means arranged at the region of the release device which upon switching-on and switching-off the release device can be respectively introduced into and retracted from the product conveying path for the products;

means for introducing and retracting the stop means synchronously with the switching-on and switching-off of the release device;

each said stop means comprises an impact surface which is moved in a direction away from the gripper elements when said stop means is introduced into the product conveying path; and said impact surface is defined by a portion of a revolvingly driven band.

35. An apparatus for the removal of flexible, flat products, especially printed products, from a product conveying stream moving in a predetermined product conveying direction and defining a product conveying path, comprising:

a conveyor device;

said conveyor device being provided with gripper elements arranged in spaced relationship from one another at said conveyor device;

at least one release device which can be selectively switched-on and switched-off;

said release device, when assuming its switched-on condition, opening the gripper elements moving therepast;

at least one stop means arranged at the region of the release device which upon switching-on and switching-off the release device can be respectively introduced into and retracted from the product conveying path for the products;

means for introducing and retracting the stop means synchronously with the switching-on and switching-off of the release device;

each said stop means comprises an impact surface which is moved in a direction away from the gripper elements when said stop means is introduced into the product conveying path;

said impact surface is provided with entrainment elements; and said impact surface comprises at least a portion of a revolvingly driven band constituted by a toothed belt having teeth defining said entrainment elements and confronting the arriving printed products.

* * * * *